US007416145B2

(12) United States Patent
Hall et al.

(10) Patent No.: US 7,416,145 B2
(45) Date of Patent: Aug. 26, 2008

(54) ROTARY IMPACT MILL

(76) Inventors: David R. Hall, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 46 days.

(21) Appl. No.: 11/424,833

(22) Filed: Jun. 16, 2006

(65) Prior Publication Data

US 2008/0041992 A1 Feb. 21, 2008

(51) Int. Cl.
*B02C 13/28* (2006.01)

(52) U.S. Cl. ..... 241/197; 241/300

(58) Field of Classification Search ..... 241/197, 241/189.1, 73, 194, 195, 300
See application file for complete search history.

(56) References Cited

U.S. PATENT DOCUMENTS 3,045,934 A * 7/1962 Eilers ..... 241/197
3,917,179 A * 11/1975 Graf ..... 241/194
4,605,343 A * 8/1986 Hibbs et al. ..... 407/119
4,638,747 A 1/1987 Brock
4,871,119 A * 10/1989 Murata et al. ..... 241/189.1
5,464,164 A * 11/1995 Doppstadt ..... 241/197
5,465,912 A * 11/1995 Graybill et al. ..... 241/27
5,938,131 A 8/1999 Thom
6,405,950 B1 6/2002 Gunderson
6,447,560 B2 * 9/2002 Jensen et al. ..... 51/293
6,521,174 B1 * 2/2003 Butcher et al. ..... 419/26
2004/0129808 A1 7/2004 Crane

* cited by examiner

*Primary Examiner*—Mark Rosenbaum
(74) *Attorney, Agent, or Firm*—Tyson J. Wilde

(57) ABSTRACT

In one aspect of the invention, a rotary impact mill has a milling chamber defined by housing with an inlet, an outlet, and at least one wall. A plurality of impact hammers located within the milling chamber are fastened to and longitudinally disposed along a rotor assembly connected a rotary driving mechanism. At least one of the impact hammers has a body with a first hardness. The impact hammer also has a wear resistant insert bonded to the body, wherein the wear resistant insert comprises a hard surface with a second hardness greater than the first hardness.

16 Claims, 12 Drawing Sheets

ROTARY IMPACT MILL

BACKGROUND OF THE INVENTION

Hammermills are often used to reduce the size of solid material. Materials often used in mills include coal, asphalt, cement, limestone, chemical fertilizer, barks, rocks, mineral, and food products. The materials are often feed into an inlet where the material falls into a milling chamber. The milling chamber typically comprises a plurality of impact hammers and may comprise a screen. The impact hammers are typically fastened at a proximal end to a rotary assembly; they are either rigidly fixed to the rotor assembly or the impact hammers may be free-swinging. As the material is feed into the chamber, the rotary assembly rotates bringing the impact hammers into contact with the material. The size reduction on each impact depends on the differential speed between the hammers and material, size of the material, and hardness of the material. If a screen is present, the screen may allow only the desired material particle size to pass to the outside of the chamber to an outlet where the particles can be collected or funneled to another machine where the material may be further processed.

Due to the impact and/or abrasive nature of the material, the impact hammers may wear requiring continual maintenance and down time of the hammermill.

In the prior art, U.S. Pat. Nos. 6,405,950; 5,938,131; 4,638,747; and U.S. Patent Publication 2004/0129808, all of which are herein incorporated by reference for all that they contain, disclose hammermills which may be compatible with the present invention.

BRIEF SUMMARY OF THE INVENTION

In one aspect of the invention, a rotary impact mill has a milling chamber defined by a housing with an inlet, an outlet, and at least one wall. A plurality of impact hammers located within the milling chamber are fastened to and longitudinally disposed along a rotor assembly connected a rotary driving mechanism. At least one of the impact hammers has a body with a first hardness. The impact hammer also has a wear resistant insert bonded to the body, wherein the wear resistant insert comprises a hard surface with a second hardness greater than the first hardness.

In some embodiments of the present invention, the body is made of steel, stainless steel, a cemented metal carbide, manganese, hardened steel, metal or combinations thereof. The hard surface may be made of a material selected from the group consisting of diamond, natural diamond, vapor deposited diamond, polycrystalline diamond, cubic boron nitride, a cemented metal carbide, or combinations thereof. The hard surface may comprise a hardness of at least twice the first hardness and in some cases at least five times the hardness.

DETAILED DESCRIPTION OF THE INVENTION AND THE PREFERRED EMBODIMENT

Figure 1:
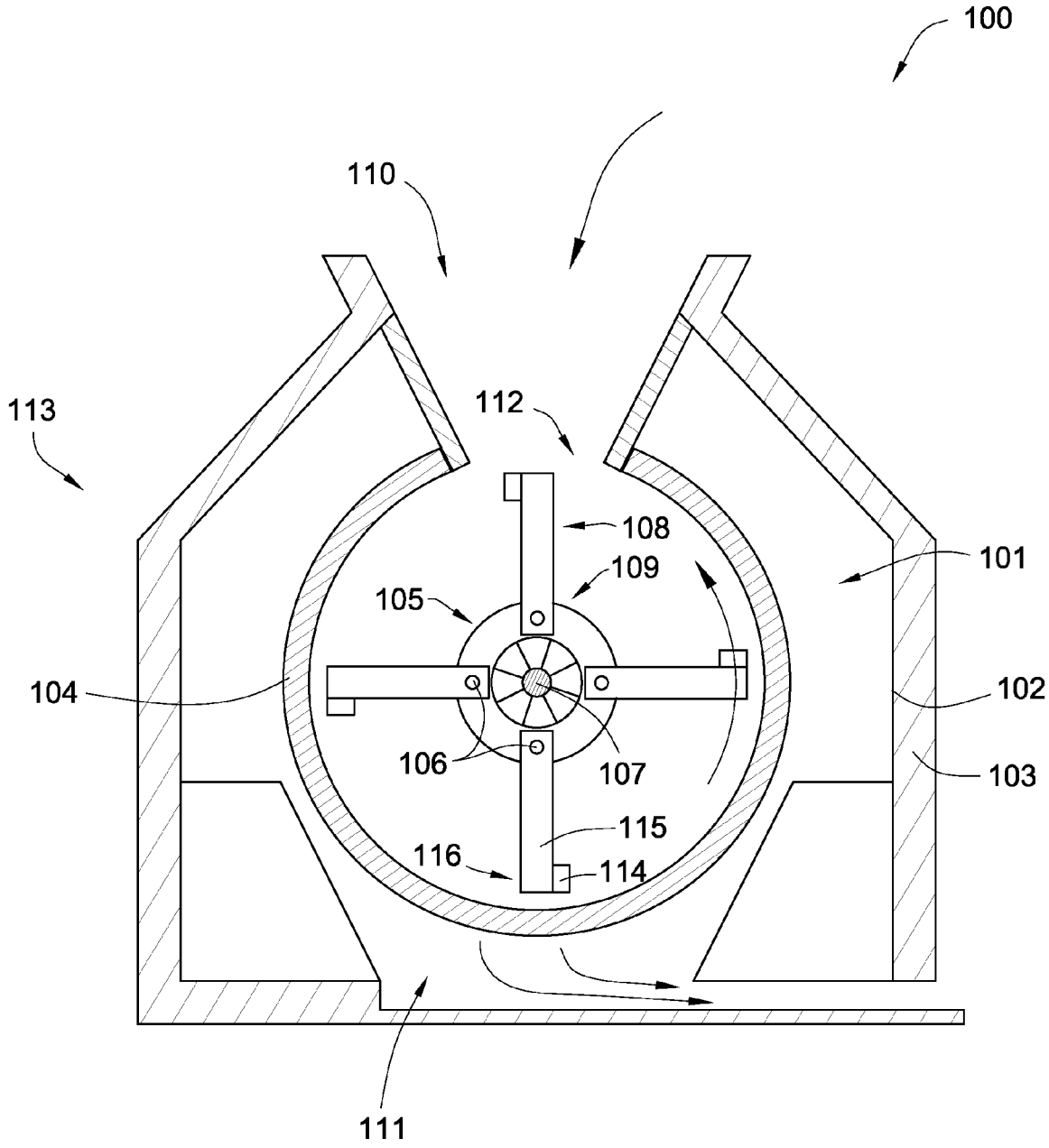
FIG. 1 is a cross sectional diagram of an embodiment of a rotary impact mill.

FIG. 1 is a perspective diagram of a rotary impact mill 100. A milling chamber 101 is defined by at least one wall 102 of a housing 103 which supports an internal screen 104, which is typically cylindrical or polygonal. Within the screen 104 a rotary assembly 105 comprises a plurality of shafts 106 connected to a central shaft 107 which is in turn connected to a rotary driving mechanism (not shown). The rotary driving mechanism may be a motor typically used in the art to rotate the rotor assembly of other hammermills. Although there are four shafts 106 shown, two, one, or any desired number of shafts may be used. A plurality of impact hammers 108 are longitudinally spaced and connected to each of the shafts 106 at the hammer's proximal end 109. The hammers 108 may be rigidly attached to the shafts 106 or the hammers 108 may be free-swinging. In some embodiments, the rotor assembly 105 comprises just the central shaft 107 and the impact hammers 108 are connected to it.

The housing 103 also comprises an inlet 110 and an outlet 111. Typically the inlet 110 is positioned above the rotor assembly 107 so that gravity directs the material towards it through an opening 112 in the screen 104, although the inlet 110 may instead be disposed in one of the sides 113 of the housing 103. When in the milling chamber 101, a material may be reduced upon contact with the impact hammers 108. The screen 104 may comprise apertures (not shown) only large enough to allow the desired maximum sized particle through. Upon impact however, a distribution of particle sizes may be formed, some capable of falling through the apertures of the screen 104 and others too large to pass through. Since the larger particle sizes may not be able pass through the apertures, they may be forced to remain within the screen 104 and come into contact again with one of the impact hammers 108. The hammers 108 may repeatably contact the material until they are sized to pass through the apertures of the screen 104.

After passage through the screen 104 the sized reduced particles may be funneled through the outlet 111 for collection. In other embodiments the particles may be directed towards another machine for further processing, such as when coal is the material being reduced and fine coal particles are directed towards a furnace for producing power. It may be necessary to provide low pressure in the vicinity of the outlet 111 to remove the particles, especially the fines, through the outlet 111. The low pressure may be provided by a vacuum.

As shown in FIG. 1, the rotor assembly 105 is positioned such it is substantially perpendicular to the flow of material feed into the inlet 110. In other embodiments, the rotor assembly 105 may be positioned such that it is substantially parallel or diagonally disposed with respect to the flow of feed material. In some embodiments, there are multiple rotor assemblies.

The impact hammers 108 comprises a wear resistant insert 114 bonded to the body 115 of the impact hammer 108. The wear resistant insert 114 may reduce wear of the hammer body 115, which is typically more extreme at the body's distal end 116.

Figure 2:
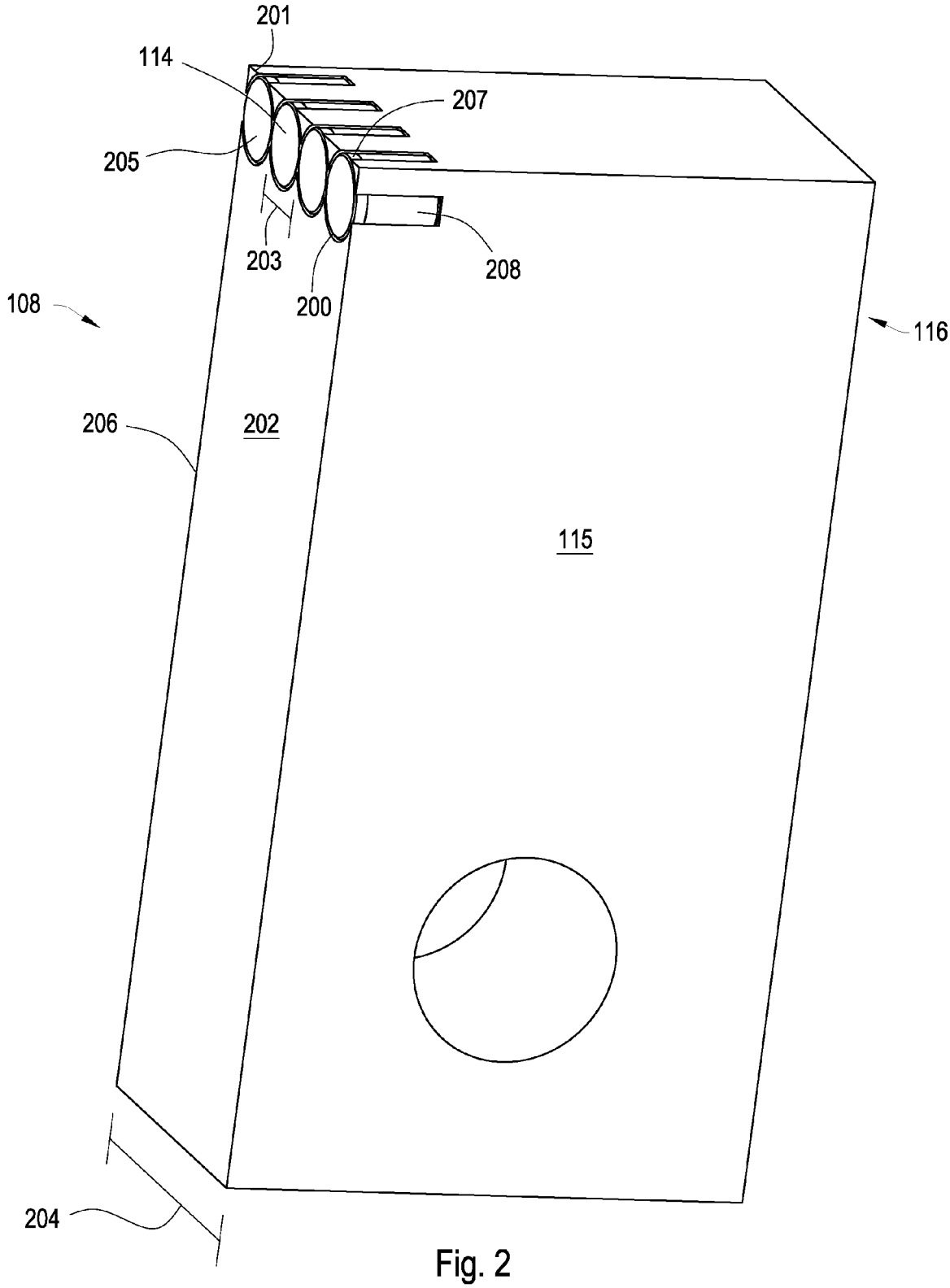
FIG. 2 is a perspective diagram of an embodiment of an impact hammer.

FIG. 2 is a perspective diagram of a preferred embodiment of an impact hammer 108. Four wear resistant inserts 114 are bonded to a distal end 116 of the impact hammer's body 115. Preferably cavities 200 are formed near the edge 201 of the body 115 on the impact side 202 of the body 115. The inserts 114 may be brazed within the cavities 200 or press fit. In some embodiments, the inserts 114 don't protrude from body 202, but are flush or retracted with in the cavity 200. The inserts 114 may protrude out of the body 0.100 to 3.00 inches depending on the material to be reduced. In some embodiments, the inserts are simply bonded to a flat surface of the body 115. The diameter 203 of the inserts may range from three mm to the entire width 204 of the body 115. Preferably 13-19 mm diameter inserts are used. Preferable a longitudinal edge insert 205 is as close to its longitudinal edge 206 as possible. To achieve this, the insert 205 may be bonded to the body 115 such that a small portion of the insert 205 hangs over the edge 206, which overhang is then removed by grinding. The overhang may be allowable, depending on the spacing of the impact hammers 108 along the rotor assembly 105. If the overhang doesn't interfere with adjacent longitudinally spaced hammers, the grinding step may not be necessary.

The body 115 of the hammers 114 may be made of steel, stainless steel, a cemented metal carbide, manganese, hardened steel, metal, or combinations thereof; each of these materials may exhibit a first hardness of the body 115. Typically hardened steel is used. The wear resistant inserts 114 may be of a solid material or a combination of materials. Preferably the insert 114 comprises the combination of a cemented metal carbide substrate 208 with a superhard material bonded to it, such as polycrystalline diamond, to form the hard surface 207. However, a superhard material may also comprise natural diamond, vapor deposited diamond, cubic boron nitride, or combinations thereof. A hard material such as a cemented metal carbide may also be sufficient to form a hard surface 207 for the wear resistant insert 114. Solid inserts of hard materials such as cemented metal carbides, diamond, natural diamond, vapor deposited diamond, polycrystalline diamond, or cubic boron nitride may also be used which already have an inherent hard surfaces 207. The surfaces of solid hard materials, in some cases, may be made harder by doping or infiltrating the materials with higher or lower concentrations of metals and/or hard materials to achieve a desired hardness. The hardness of the hard surface 207 may be at least twice as hard as the first hardness of the hammer body 115. In other embodiments, the hard surface 207 is at least five times as hard. In the preferred embodiment, a hardened steel body is used with the preferred insert.

The hard surface 207 may be bonded to the substrate 208 with a non-planar interface to increase the strength of the bond. Also the superhard material may be a sintered body, such as in embodiments where a polycrystalline diamond is used, and may be made thermally stable by removing a thin layer of metal binders (which may have a high coefficient of thermal expansion than the grains of the superhard material) in the hard surface by leaching. In other embodiments, the hard surface may comprises a metal binder concentration less 40 weight percent. In embodiments, where polycrystalline diamond is used a higher concentration of cobalt typically reduces the brittleness of the polycrystalline diamond but as a tradeoff increases it susceptibility to wear. Preferably the polycrystalline diamond has a cobalt concentration of four to ten weight percent. Adjusting the metal binder concentration in the cemented metal carbide may also have the same effect. Preferably the carbide is a tungsten carbide comprising a cobalt concentration of 6 to 14 weight percent. Polycrystalline diamond grain size distribution can also play an important role in the strength of the diamond and also in its failure mode. Preferably, the grain sizes are within 0.5 to 300 microns. Preferably, the hard surface 207 is also polished to reduce crack initiation starting points that may be created during manufacturing. Although several preferred characteristics have been identified, any concentrations and characteristics of hard surfaces 207 are encompassed within the claims.

Although the impact hammer 108 comprises a generally rectangular shape, the impact hammer 108 may comprise any general shape including, but not limited to generally cylindrical, generally triangular, tapers, beveled, generally conical, generally stepped, or combinations thereof.

In some embodiments of the present invention, the hammer is a bar hammer, a T-shaped hammer, a ring-type hammer, a toothed type-ring hammer or combinations thereof.

Figure 3:
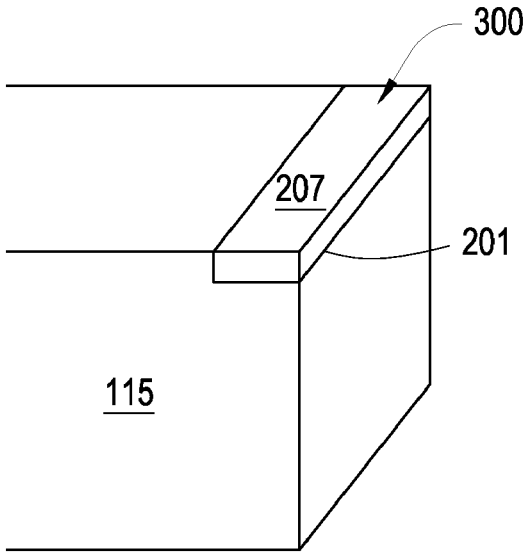
FIG. 3 is a perspective diagram of another embodiment of an impact hammer.
Figure 4:
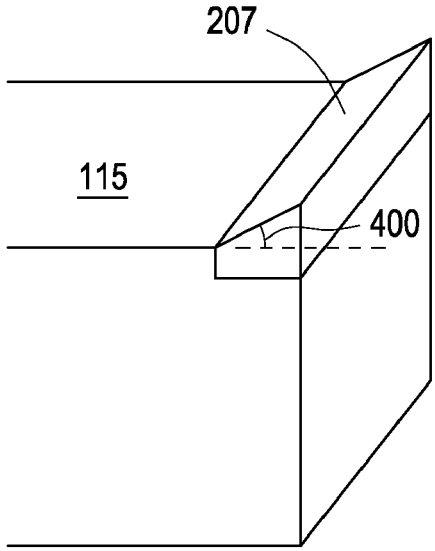
FIG. 4 is a perspective diagram of another embodiment of an impact hammer.
Figure 5:
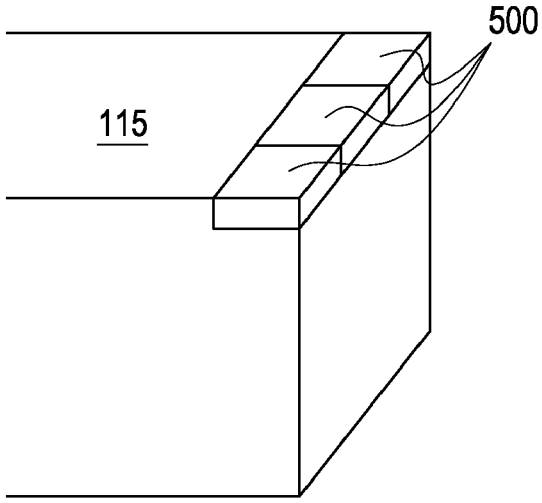
FIG. 5 is a perspective diagram of another embodiment of an impact hammer.

FIG. 3 discloses a single flat insert 300 bonded to a distal most edge 201 of the hammer body 115. This insert may be made of a solid material such as tungsten carbide or polycrystalline diamond, or it may also comprise a carbide substrate with a hard or superhard material bonded to it. The edge 201 is recessed slightly such that the hard surface 207 is flush with the body 115. The insert 300 may be bonded to body 115 with a braze material braze material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof. FIG. 4 discloses an insert similar to the embodiment disclosed in FIG. 3 except that its surface 207 forms a positive angle 400 with the surface of the body 115. This may be advantageous in embodiments where it is desired to have the hard surface 207 be more aggressive in cutting the material instead of mostly impacting the material. FIG. 5 discloses a plurality of smaller inserts 500 bonded to the hammer 108. This may be advantageous in that large polycrystalline diamond inserts may be more expensive to fabricate than smaller inserts.

Figure 6:
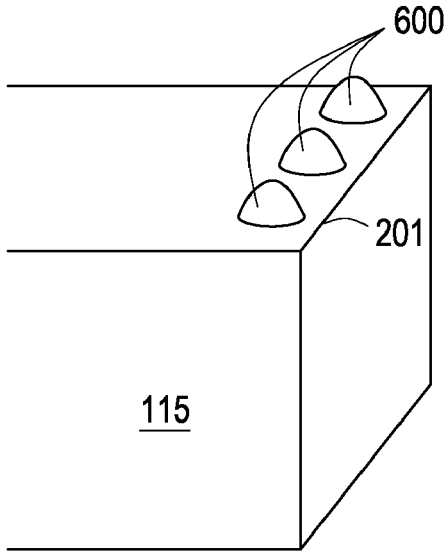
FIG. 6 is a perspective diagram of another embodiment of an impact hammer.
Figure 7:
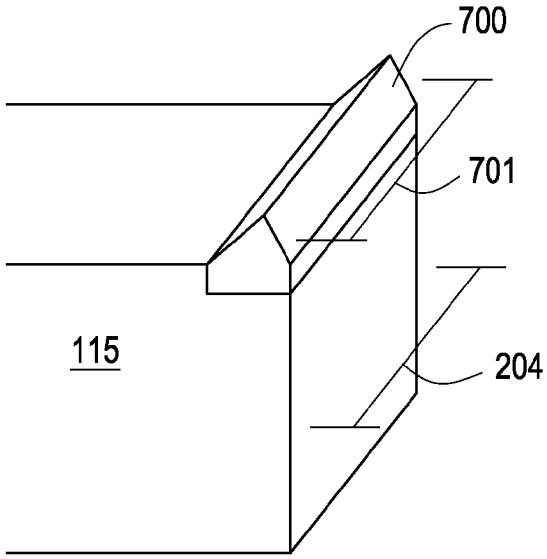
FIG. 7 is a perspective diagram of another embodiment of an impact hammer.
Figure 8:
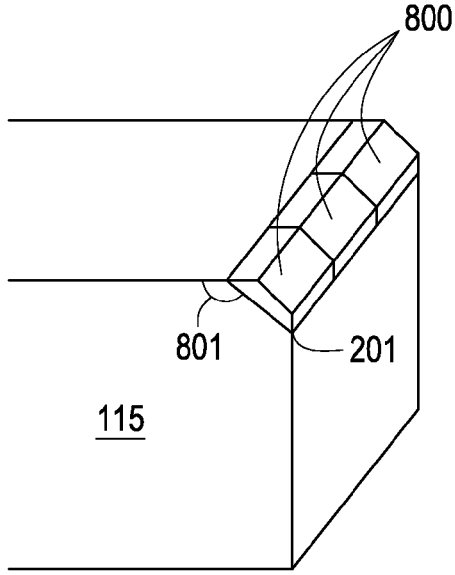
FIG. 8 is a perspective diagram of another embodiment of an impact hammer.

FIG. 6 discloses a plurality of domed inserts 600 bonded proximate the distal edge 201 of the hammer body 115. Contacting the material with a domed insert 600 may generate a more explosive impact than a sharper insert. The desired balance of blunt inserts to sharp inserts would depend on the type of material being reduce, the rate that material is feed into the milling chamber, and the differential speed being the material and insert. FIG. 7 discloses a triangular inserts 700 which an axial length 701 disposed along the width 204 of the hammer body 115. FIG. 8 discloses multiple inserts 800 bonded to the distal most edge 201 of the hammer body 115 which form a negative angle 801 with the hammer body surface. The negative angle 801 may reduce the forces involved with the impact between the material and the insert, but it may also reduce the inserts susceptibility to wear. Again, depending on the type of material being reduced, inserts positioned in a negative or positive rake angle desired.

Figure 9:
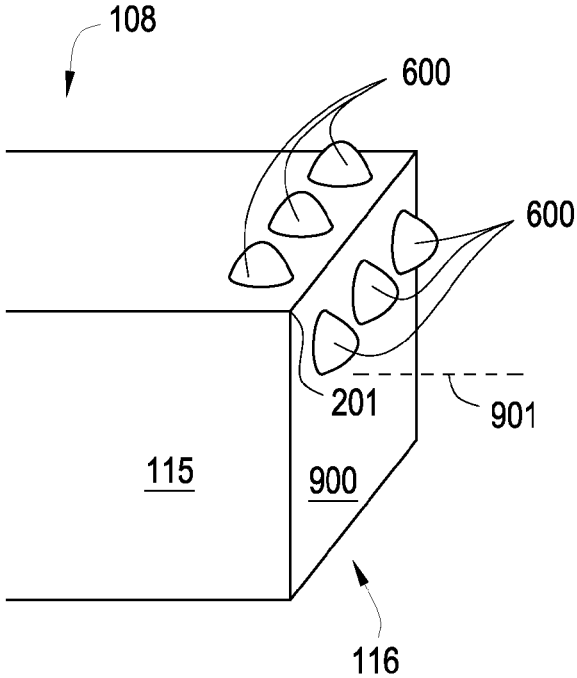
FIG. 9 is a perspective diagram of another embodiment of an impact hammer.
Figure 10:
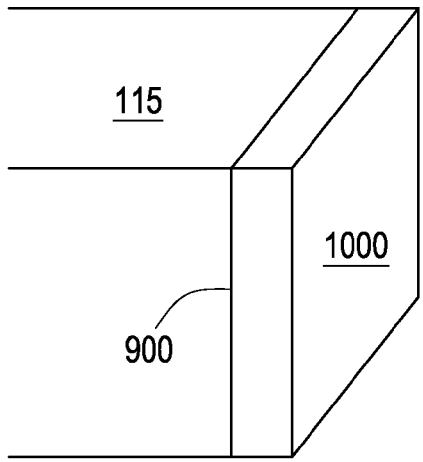
FIG. 10 is a perspective diagram of another embodiment of an impact hammer.
Figure 11:
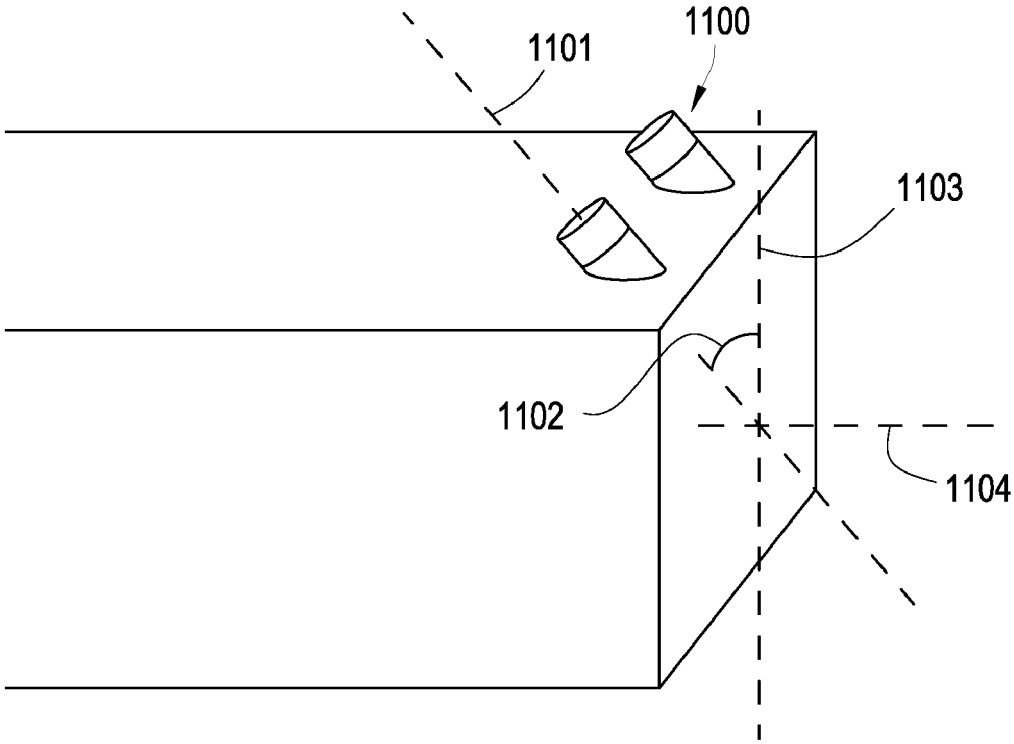
FIG. 11 is a perspective diagram of another embodiment of an impact hammer.
Figure 12:
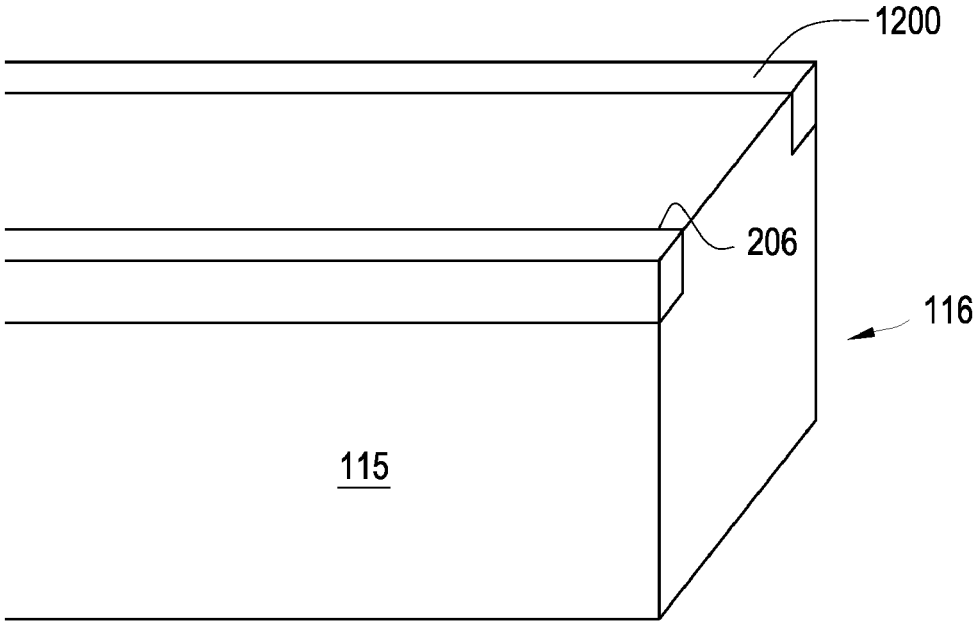
FIG. 12 is a perspective diagram of another embodiment of an impact hammer.

FIG. 9 discloses a hammer body 115 with domed inserts 600 bonded proximate the distal edge 201. A distal surface 900 substantially normal to the axis 901 of the hammer body 115 also comprises a plurality of inserts 600. This may be advantageous for reducing wear of the distal end 116 of the hammer 108 in situations where the distal end 116 of the hammer body 108 comes into contact with the screen 104 (see FIG. 1) or if a material particle braces itself between the screen 104 and the hammer 108. FIG. 10 discloses a signal flat insert 1000 bonded directly to the distal normal surface 900. FIG. 11 discloses inserts 1100 positioned such that their axes 1101 form an angle 1102 with a line normal 1103 the axial length 1104 of the hammer body 115. Again, positive or negative angles may be desirable depending on the type of material being reduced. It is believed that the harder and/or more abrasive of a material being reduced, the more negative an angle ought to be, since this would reduce the amount of wear the hard surface would be exposed to. FIG. 12 discloses inserts 1200 bonded to longitudinal edges 206 of the hammer body 115. Material particles may pass over the longitudinal edges 206 and also be susceptible to wear. The distal end 116 of the hammer body 115 is typically more susceptible to wear because it travels the farthest distance per rotation of the rotor assembly 105 causing the distal end 116 to travel at a higher velocity than the rest of the hammer body 115 and causing it to be more susceptible to wear. Although other regions of the hammer body may be less susceptible to wear, they may still come into contact with the material being reduced and may benefit from having a wear resistant insert bonded to it. Although the embodiment of FIG. 12 discloses a single solid long insert 1200 bonded to the longitudinal edge 206, in other embodiments the smaller inserts may be positioned longitudinally and adjacent one another along the edge. Further any geometry of insert may be used.

FIGS. 13-32 all disclose various embodiments of geometries of the inserts 114. Each geometry may be advantageous depending on the material and application of the rotary impact mill. These inserts may be bonded or otherwise attached anywhere on the hammer body, although they are preferably attached proximate its distal end. In embodiments, where the rotation of the rotor assembly is revisable, it may be beneficial to have the wear resistant inserts bonded to the side of the body opposite of the impact side.

Figure 13:
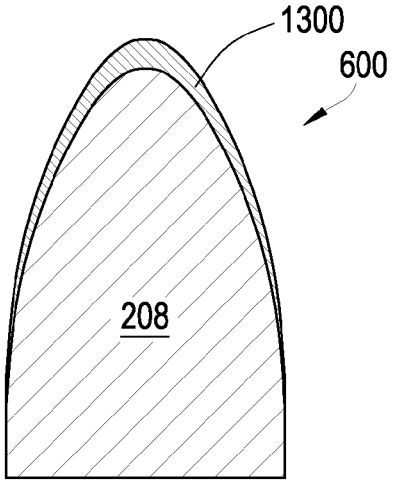
FIG. 13 is a cross sectional diagram of an embodiment of a wear resistant insert.
Figure 14:
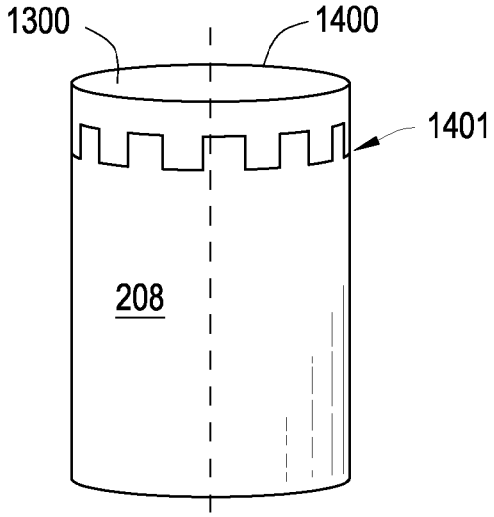
FIG. 14 is a perspective diagram of another embodiment of a wear resistant insert.
Figure 15:
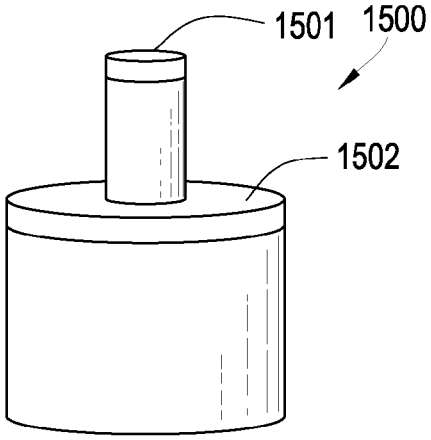
FIG. 15 is a perspective diagram of another embodiment of a wear resistant insert.
Figure 16:
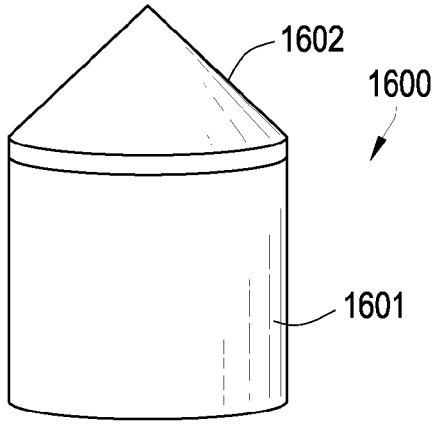
FIG. 16 is a perspective diagram of another embodiment of a wear resistant insert.
Figure 17:
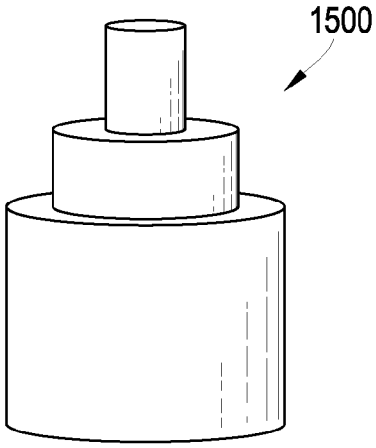
FIG. 17 is a perspective diagram of another embodiment of a wear resistant insert.
Figure 18:
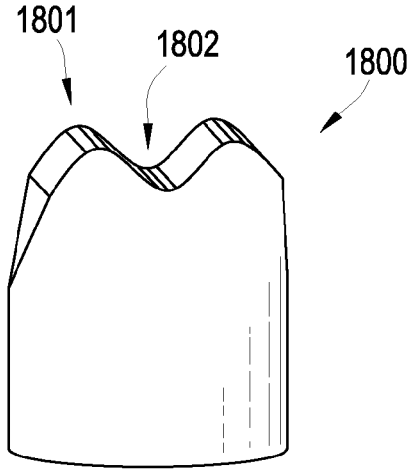
FIG. 18 is a perspective diagram of another embodiment of a wear resistant insert.

FIG. 13 discloses a rounded insert 600. A rounded insert 600 may include a domed insert, a semi-spherical insert, a conical insert, or combinations thereof. A layer of hard material, preferably a superhard material 1300 such as polycrystalline diamond is bonded to the substrate 208. Preferably, the superhard layer is made of diamond and is bonded to the substrate 208 while still in the high pressure, high temperature press. FIG. 14 discloses an insert with a flat head 1400. A non-planar interface 1401 between the hard layer 1300 and substrate 208 is shown. FIG. 15 discloses a stepped insert 1500. This may be advantageous since the top plateau 1501 will contact the material first with a small surface area allowing a greater penetration into the material, thereby weakening the material just before the second plateau 1502 contacts the now weakened region of the material allowing the impact of the second plateau to affect a greater volume of the material. FIG. 16 discloses an insert 1600 with a generally cylindrical shape 1601 and a conical end 1602. FIG. 17 discloses another embodiment of a stepped insert 1500, but with more plateaus. FIG. 18 discloses an insert 1800 with at least one peak 1801 and at least one recess 1802.

Figure 19:
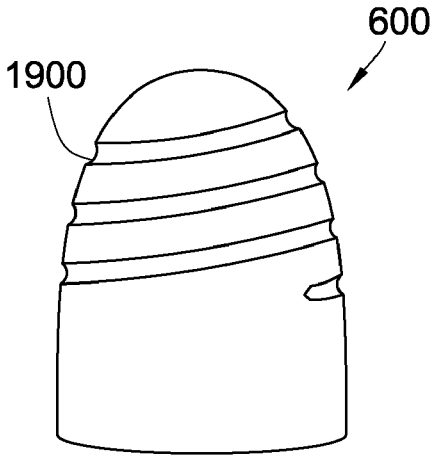
FIG. 19 is a perspective diagram of another embodiment of a wear resistant insert.
Figure 20:
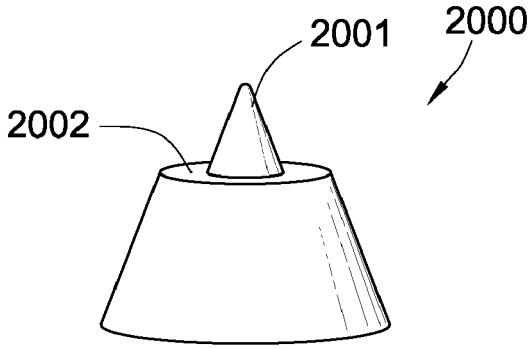
FIG. 20 is a perspective diagram of another embodiment of a wear resistant insert.
Figure 21:
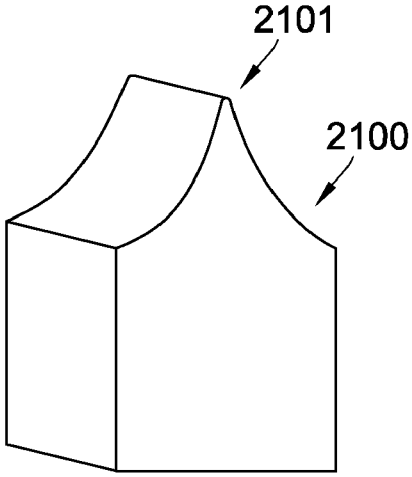
FIG. 21 is a perspective diagram of another embodiment of a wear resistant insert.
Figure 22:
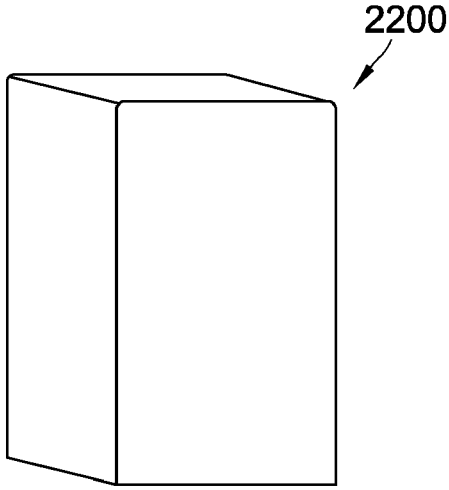
FIG. 22 is a perspective diagram of another embodiment of a wear resistant insert.
Figure 23:
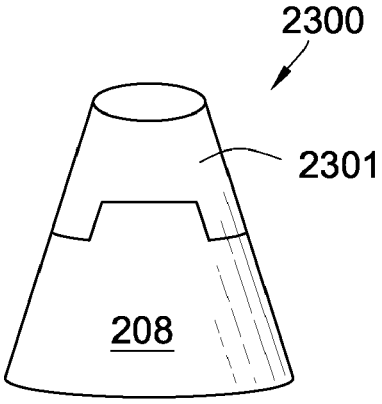
FIG. 23 is a perspective diagram of another embodiment of a wear resistant insert.
Figure 24:
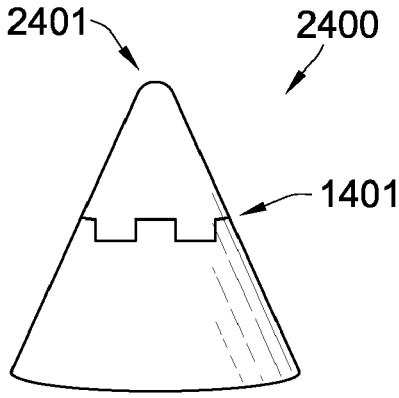
FIG. 24 is a perspective diagram of another embodiment of a wear resistant insert.
Figure 25:
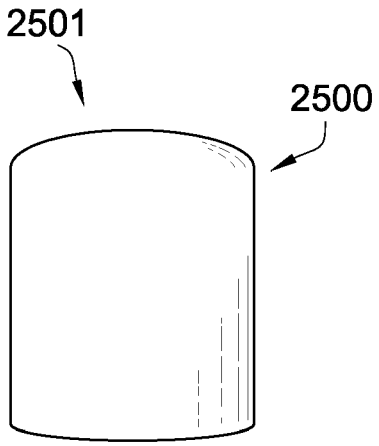
FIG. 25 is a perspective diagram of another embodiment of a wear resistant insert.
Figure 26:
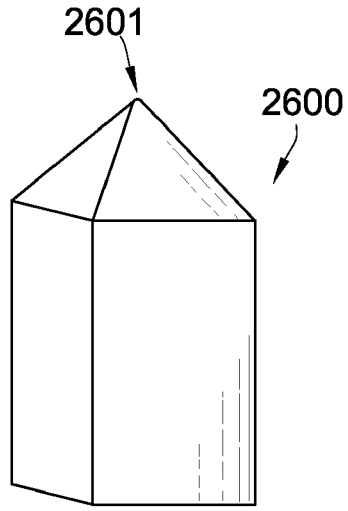
FIG. 26 is a perspective diagram of another embodiment of a wear resistant insert.

FIG. 19 discloses a rounded insert 600 with a spiral groove 1900 formed in it. Any pattern of grooves 1900 may be used. Grooves that substantially lie parallel to the axis of the insert 600 may also be beneficial. FIG. 20 discloses a frustoconical insert 2000 with a conic section 2001 form on its plateau 2002. FIG. 21 discloses a generally rectangular insert 2100 with a concave inwardly sloping top 2101. FIG. 22 discloses a generally rectangular insert 2200. FIG. 23 discloses a frustoconical insert 2300 with a hard layer 2301 bonded to a substrate 208. FIG. 24 discloses a generally conical insert 2400 with a rounded tip 2401. A non-planar interface 1401 is also disclosed. FIG. 25 discloses a slightly convex top surface 2501 of an insert 2500. FIG. 26 discloses a generally pyramidal insert 2600 with a generally triangular top 2601.

FIGS. 27-32 all disclose an insert with an asymmetric geometry. In many cases the asymmetry may deflect the material particles in a various paths. Because the differential speed between the material and the impact hammers has end effect on the efficiency of the size reduction, it may be advantageous to deflect some of the particles. After impact with a symmetric hammer the particle will tend to travel in the same direction as the hammer, lowering the speed differential because both the material and the hammer are traveling in the same vector. However, it is believed if the particles are deflected such that some of the momentum of is pushing the particle in a different direction, the differential speed between the hammer and particle within the same vector is reduce per same unit of impact force. There may be different inserts with different geometries bonded to the same hammer body, some of which may deflect the particles in different paths from one another.

Figure 27:
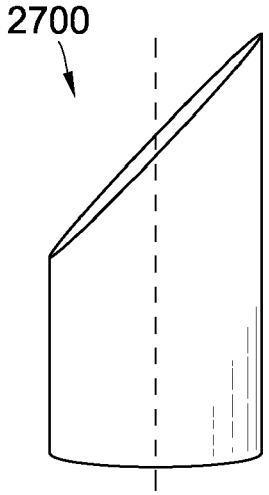
FIG. 27 is a perspective diagram of another embodiment of a wear resistant insert.
Figure 28:
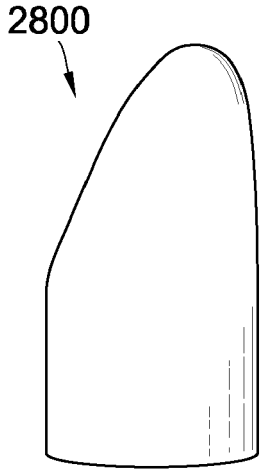
FIG. 28 is a perspective diagram of another embodiment of a wear resistant insert.
Figure 29:
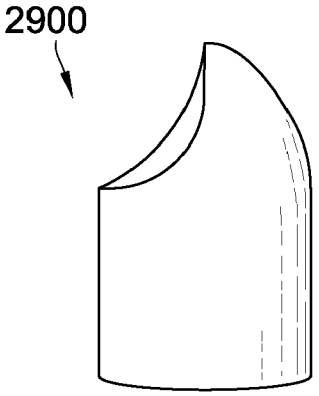
FIG. 29 is a perspective diagram of another embodiment of a wear resistant insert.
Figure 30:
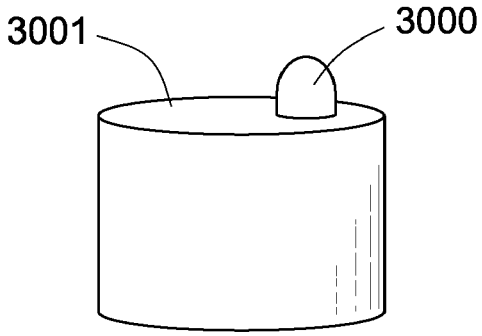
FIG. 30 is a perspective diagram of another embodiment of a wear resistant insert.
Figure 31:
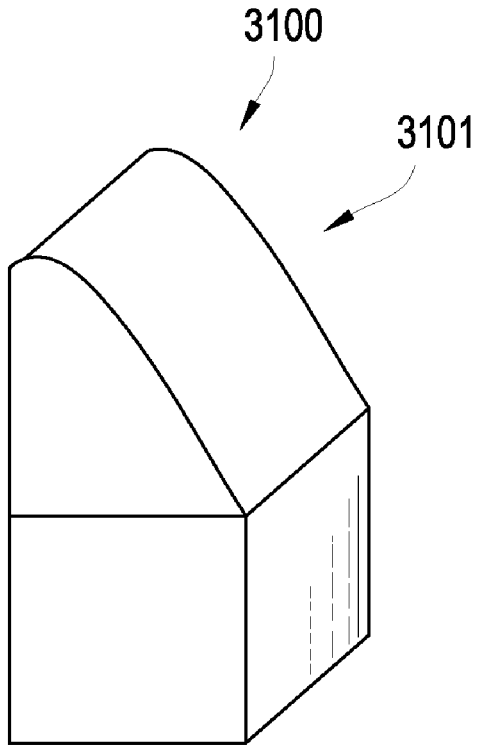
FIG. 31 is a perspective diagram of another embodiment of a wear resistant insert.
Figure 32:
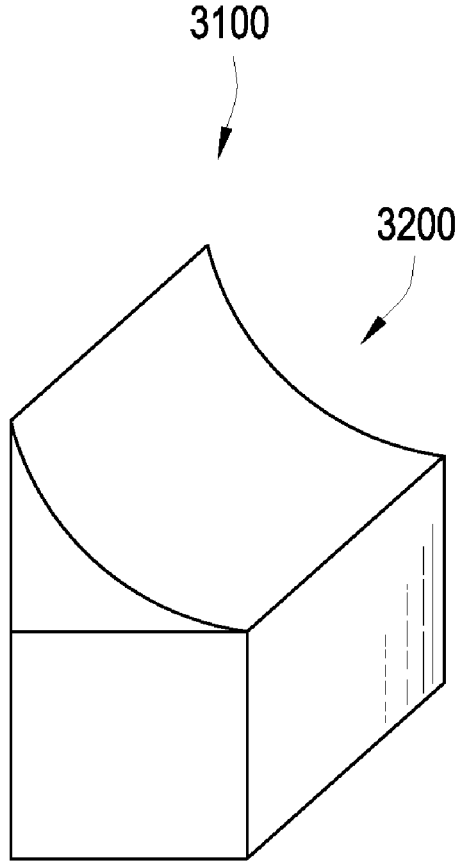
FIG. 32 is a perspective diagram of another embodiment of a wear resistant insert.

FIG. 27 discloses an angled face 2700. FIG. 28 discloses an asymmetric rounded top 2800. FIG. 29 discloses a scoop 2900 and FIG. 30 discloses an offset protrusion located 3000 on a flat face 3001. FIGS. 31 and 32 disclose offset apexes

3100. FIG. 31 discloses rounding to the apex 3100 with a convex slope 3101 and FIG. 32 rounding to the apex 3100 with a concave slope 3200.

Figure 33:
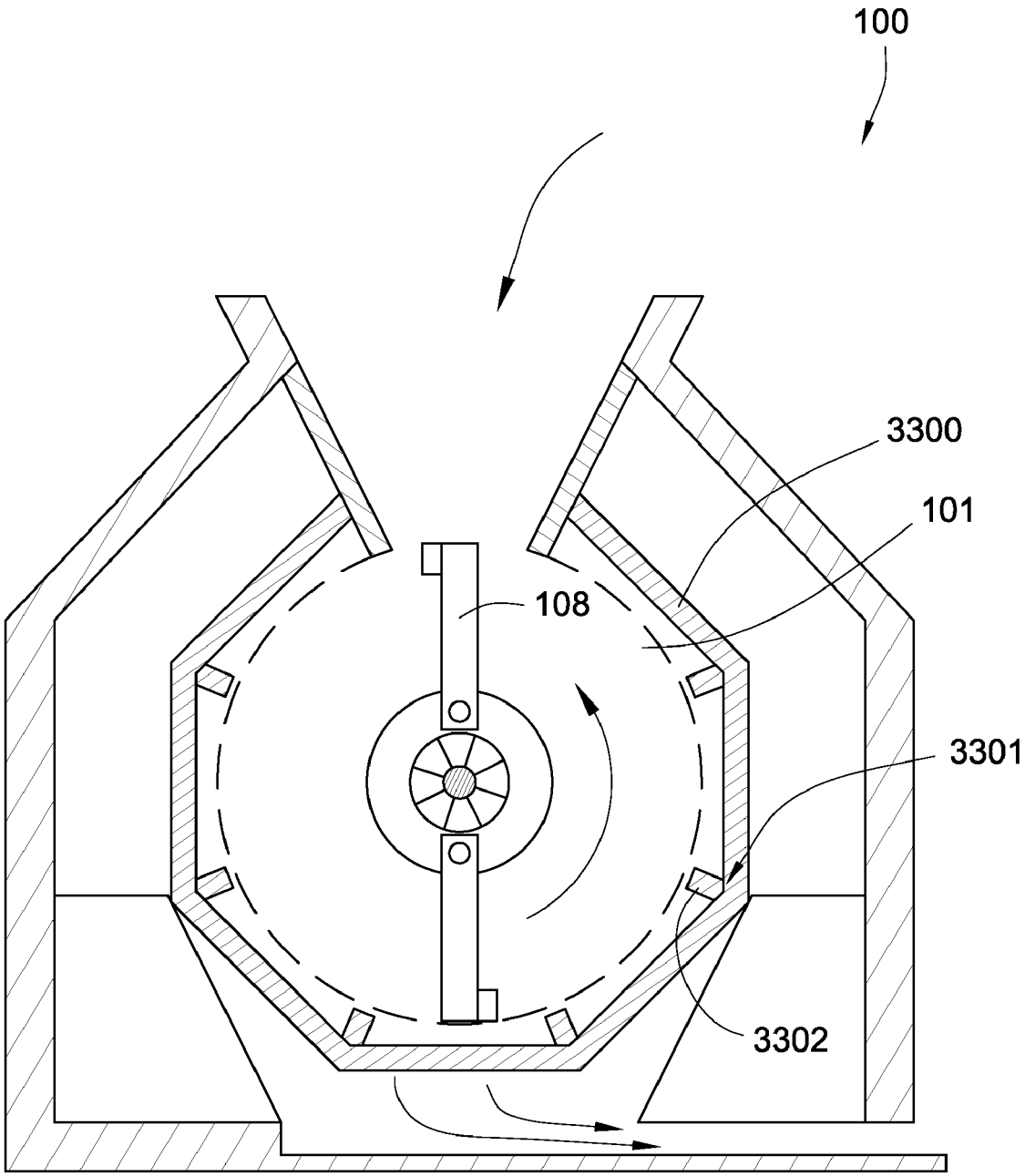
FIG. 33 is a cross sectional diagram of another embodiment of a rotary impact mill.

FIG. 33 discloses a rotary impact mill 100 with a polygonal screen 3300. As the impact hammers 108 travel within a circular path within the milling chamber 101 the corners 3301 of the polygonal screen 3300 may help to agitate the particles and help in size reduction. In some embodiments, there may be deflectors 3301 positioned within the corners 3301 or other places within the milling chamber 101 which help agitate the particles. These deflectors 3302 may also be subject to wear due to some of the high particle velocities. These deflectors 3302 may also comprise a wear resistant insert 114 with a hard surface. In some embodiments, the screen 3300 may be adapted to shake, oscillate, rock, or otherwise move to further help agitate the particles of the material.

Figure 34:
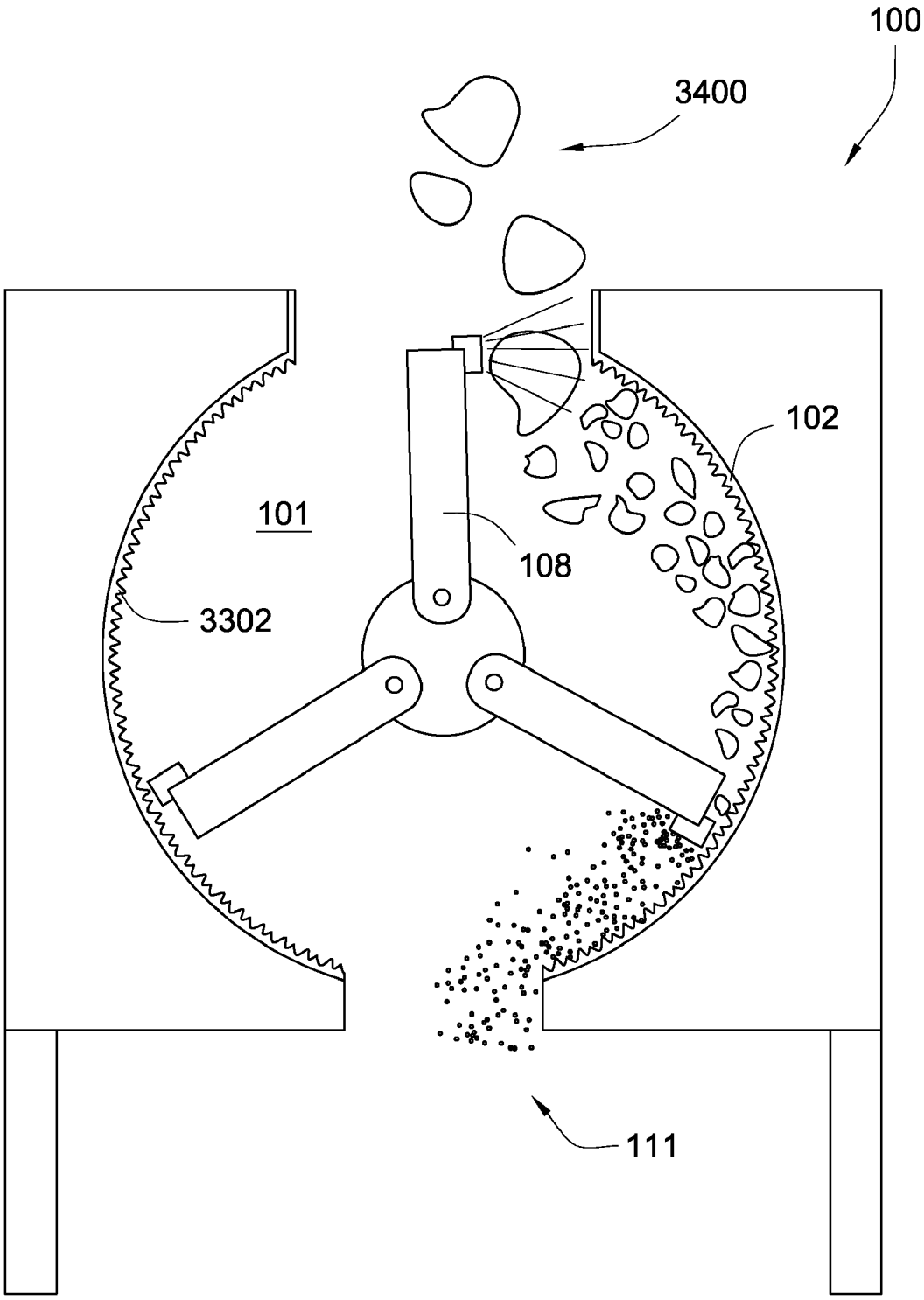
FIG. 34 is a cross sectional diagram of another embodiment of a rotary impact mill.

FIG. 34 discloses an embodiment of the rotary impact mill 100 with no screen. As material 3400 is feed into the milling chamber 101 the material is reduced upon impact with the impact hammers 108 and thrust towards a plurality of deflectors 3302 attached to at least one wall 102 of the milling chamber 101. The material may be reduced again upon impact with the deflectors 3302 and again reduced each time the material comes into contact with the impact hammers 108 until the material particles fall through the outlet 111 at the bottom of the milling chamber 101.

Figure 35:
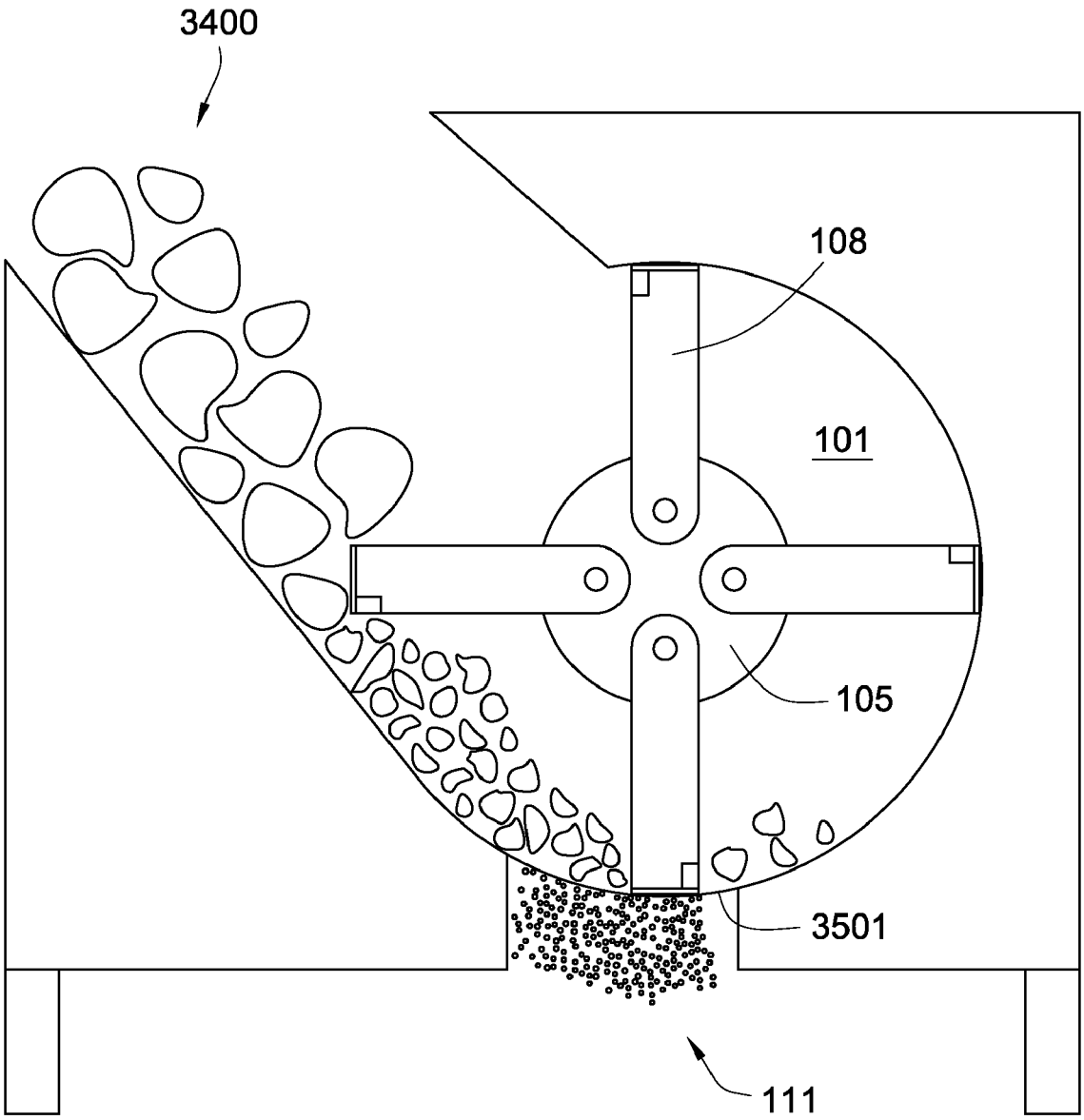
FIG. 35 is a cross sectional diagram of another embodiment of a rotary impact mill.

FIG. 35 discloses an offset inlet of the milling chamber 101. The impact hammers 108 direct the material 3400 upon contact over a screen 3501 disposed above the outlet 111 of the milling chamber 101. In this case, the impact hammers 108 are rigidly fixed to the rotor assembly 105. The hammers 108 force an intimate contact between the material 3400 and the screen 3501, such that particles of the material 3400 are sheared off into the outlet 111. In some embodiments, the screen may also move, causing the material to be reduced by attrition. Material particles too large to pass through the screen 3501 are cycled through the milling chamber 101 back to the screen 3501 until they are the appropriate size.

Whereas the present invention has been described in particular relation to the drawings attached hereto, it should be understood that other and further modifications apart from those shown or suggested herein, may be made within the scope and spirit of the present invention.

What is claimed is:

1. A rotary impact mill, comprising:

a milling chamber being defined by a housing with an inlet, an outlet, and at least one wall;

a plurality of rectangularly shaped impact hammers fastened to and longitudinally disposed along a rotor assembly connected to a rotary driving mechanism;

at least one of the impact hammers comprising a body having a first hardness;

the impact hammer also comprising a plurality of wear resistant, rounded inserts, fixed within recesses formed in the body and protruding beyond a surface of an impact side of the body proximate a distal end of the body, wherein the wear resistant inserts comprise a cemented metal carbide base segment attached to a distal end of the body and a hard surface comprises a layer of diamond or cubic boron nitride which is bonded to the base segment wherein the rounded inserts comprise a substantially conical end protruding beyond an impact side of the hammer body wherein the conical end comprises a rounded apex.

2. The mill of claim 1, wherein the body comprises steel, stainless steel, a cemented metal carbide, manganese, hardened steel, or combinations thereof.

3. The mill of claim 1, wherein a proximal end of the impact hammer is fastened to the rotor assembly.

4. The mill of claim 1, wherein the wear resistant insert comprises an axis that forms an angle with a line normal to axial length of the body.

5. The mill of claim 1, wherein the wear resistant inserts protrude beyond the body by 0.100 to 3.00 inches.

6. The mill of claim 1, wherein the wear resistant inserts are brazed or press fit into the recesses of the body.

7. The mill of claim 1, wherein the wear resistant inserts are adapted to deflect debris at an angle.

8. The mill of claim 1, wherein the layer is thermally stable.

9. The mill of claim 1, wherein the layer is bonded to a non-planar interface with the base segment.

10. The mill of claim 1, wherein the layer comprises a metal binder concentration less than 40 weight percent.

11. The mill of claim 1, wherein the layer comprises a grain size distribution of 0.5 to 300 microns.

12. The mill of claim 1, wherein the layer comprises a polish finish.

13. The mill of claim 1, wherein the wear resistant inserts are bonded to an edge of the body.

14. The mill of claim 1, wherein a distal end of the body comprises a distal surface opposite the proximal end and substantially normal to the axial length of the body, wherein the distal surface comprises a hard surface.

15. The mill of claim 1, wherein a screen is disposed within the milling chamber and adapted to move in a different direction than a direction of the plurality of impact hammers.

16. The mill of claim 1, wherein a wear resistant coating is bonded to a deflector located within the milling chamber.

* * * * *